United States Patent [19]

Baugh et al.

[11] 4,399,870

[45] Aug. 23, 1983

[54] ANNULUS OPERATED TEST VALVE

[75] Inventors: John L. Baugh, Huntsville; James W. Montgomery, Houston; Phillip H. Manderscheid, Cypress, all of Tex.

[73] Assignee: Hughes Tool Company, Houston, Tex.

[21] Appl. No.: 313,901

[22] Filed: Oct. 22, 1981

[51] Int. Cl.[3] ..... E21B 34/14

[52] U.S. Cl. ..... 166/324; 166/319; 166/373; 166/386

[58] Field of Search ..... 166/324, 319, 321, 323, 166/334, 373, 374, 386, 332; 251/58, 62

[56] References Cited

U.S. PATENT DOCUMENTS

| | | | |
|---|---|---|---|
| Re. 25,471 | 11/1963 | Fredd | 166/321 X |
| 3,200,837 | 8/1965 | Brown | 137/496 |
| 3,750,751 | 8/1973 | Mott | 166/321 |
| 3,830,297 | 8/1974 | Cockrell | 166/224 |
| 3,856,085 | 12/1974 | Holden et al. | 166/264 |
| 4,071,088 | 1/1978 | Mott | 166/321 X |
| 4,144,937 | 3/1979 | Jackson et al. | 251/58 X |
| 4,340,088 | 7/1982 | Geison | 251/58 X |

*Primary Examiner*—Stephen J. Novosad
*Assistant Examiner*—Thuy M. Bui
*Attorney, Agent, or Firm*—Robert A. Felsman; Charles D. Gunter, Jr.

[57] ABSTRACT

A valve used in a drill stem test tool has a ball movable between an open position to allow flow through the drill string for testing and a closed position to block flow. Operating means move the ball between the open and closed positions in response to pressures in the well annulus. A nitrogen filled pressure chamber and pressure balancing piston compensate for variations in annular pressure as the tool is being lowered into position in the well. Actuating means including a weight operated sleeve are operated from the surface to overcome the compensating effect of the pressure balancing piston to allow the ball to be rotated to the open position. The ball is spring biased toward the closed position by a coil spring located inside the pressure chamber. Relieving pressure in the annulus causes the spring to close the ball.

10 Claims, 13 Drawing Figures

ANNULUS OPERATED TEST VALVE

BACKGROUND OF THE INVENTION

This invention relates in general to flow control valves for drill stem test tools of the type used to test oil producing formations and specifically to flow control valves which are opened and closed in response to external pressure in the well annulus.

Drill stem test (DST) tools are mounted in the drill stem or string and are used to evaluate the producing potential or productivity of an oil or gas bearing zone prior to completing a well. Thus, as drilling proceeds, various indications such as core samples may suggest the desirability of testing a certain formation for producing potential. To conduct the test, a packer and valve assembly is lowered on the drill stem into the uncased well bore to the zone to be tested. The packer is then set and the valve is opened for flow to the well surface.

Various techniques have been utilized to open and close DST valves once the tool has been placed in the well bore. Such techniques commonly comprise rotating the drill stem in a clockwise or counter-clockwise direction, sometimes coupled with lifting up or setting weight down on the tool from the surface. Such techniques are satisfactory in straight well bores such as are commonly encountered on land but are problematical in deviated well bores of the type commonly employed in off-shore drilling operations. A need exists, therefore, for a DST valve which is operable between open and closed positions with a minimum of mechanical manipulation of the drill stem. One solution to this problem is to incorporate an operating means in the DST valve which moves the valve between open and closed positions in response to pressure in the surrounding well annulus. The well bore can then be enclosed and "pressured-up" to operate the valve. Since annulus pressure varies with depth, unexpected variations in pressure can cause the valve to open prematurely. The tool must, therefore, be designed to compensate for variations in the hydrostatic head in the well annulus as the tool is placed and retrieved from the well bore.

SUMMARY OF THE INVENTION

The improved annulus operated valve of this invention has a ball which is movable between an open position to allow flow through the drill string for testing and a closed position to block flow through the drill string during placement and retrieval of the tool in the well bore. Operating means are provided for moving the ball between the open and closed positions in response to pressure in the well annulus. A pressure balancing means is movable between an active position to compensate for variations in annulus pressures and prevent premature opening of the ball and a static position which allows the operating means to open the ball in response to annulus pressure. Actuating means allow the pressure balancing means to be set between the active and static positions by lifting up or setting weight down on the tool at the well surface.

In the preferred embodiment, a pair of shifting linkages extend from opposite sides of the ball. The linkages are adapted to shift in opposite relative directions to open and close the ball valve. A pressure operated inner mandrel slidably engages the first shifting linkage. The inner mandrel is movable between retracted and extended positions in response to pressures in the annulus to shift the first linkage and open the ball.

A sliding spring sleeve surrounds the inner mandrel and engages the second shifting linkage so that movement of the inner mandrel and first linkage causes opposite relative movement of the spring sleeve and second shifting linkage. The spring sleeve is spring-biased thereby urging the ball to the closed position when pressure in the annulus is reduced.

The pressure balancing means includes a fluid-containing pressure chamber having a balancing piston at one end. One side of the balancing piston communicates with the well annulus when the pressure balancing means is active but is isolated from the well annulus when the pressure balancing means is in the static position. Movement of the inner mandrel from the retracted to the extended position compresses fluid in the pressure chamber and exerts pressure on the opposite side of the balancing piston. As long as the pressure balancing means is in the active position, pressure in the well annulus acts on the balancing piston opposing movement of the inner mandrel and holding the ball closed. Actuating means are provided to move the pressure balancing means to the static position, thereby isolating the balancing piston from pressure in the well annulus and allowing the inner mandrel to move and open the ball.

Additional objects, features, and advantages of the invention will be apparent in the following description.

BRIEF DESCRIPTION OF THE DRAWINGS

FIGS. 1*b*, 2*b*, 3*b*, 4, and 5*b*, together constitute a longitudinal quarter section of the valve of this invention in the open position, FIGS. 1*b* through 5*b*, respectively, constituting successive downward continuations of FIG. 1*b*.

DETAILED DESCRIPTION OF THE INVENTION

Figure 1A:
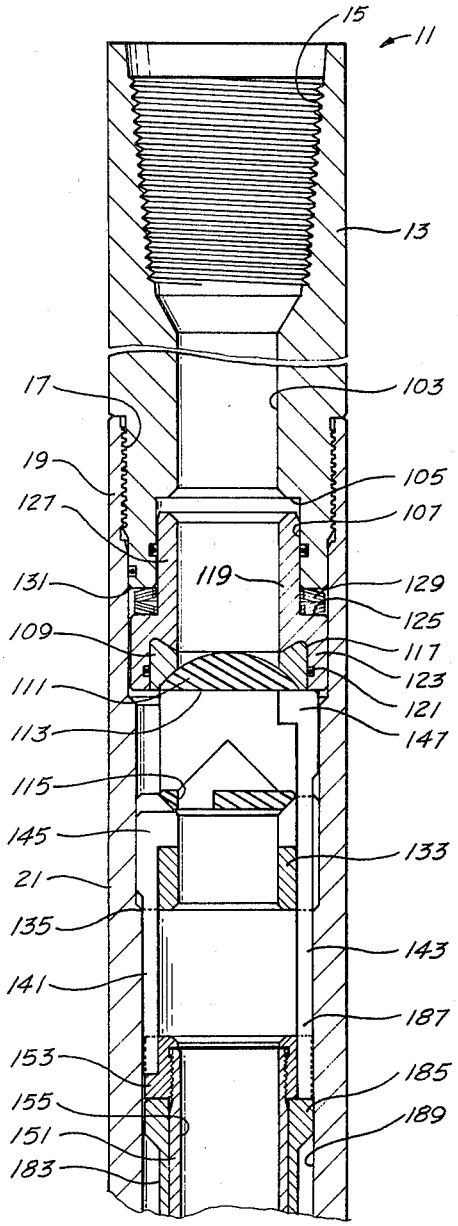
FIGS. 1*a*, 2*a*, 3*a*, 4, and 5*a*, together constitute a longitudinal quarter section of the valve of this invention in the closed position, FIGS. 1*a* through 5*a*, respectively, constituting successive downward continuations of FIG. 1*a*.

Referring now to FIG. 1*a*, there is shown an annulus operated test valve designated generally as 11 which is designed to be installed in a string of well production tubing by means of a top connection 13. The test valve will normally be run into the well bore with the top connection 13 toward the surface. The tubing string will normally be anchored into position and the test zone sealed off by means of a packer (not shown) located below the test valve in a length of tubing secured to the pin end 45 (FIG. 5) of the test tool. For the purposes of this discussion "top" or "upward" will mean in the direction of the top connection 13 of the tool and toward the surface and "bottom" or "downward" will mean in the direction of the pin end 45.

Figure 2A:
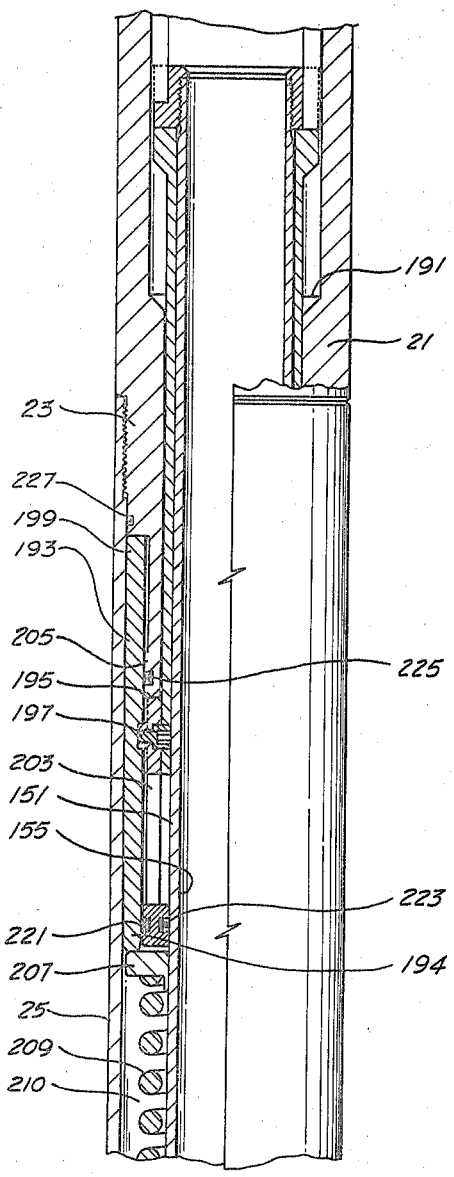
Figure 2B:
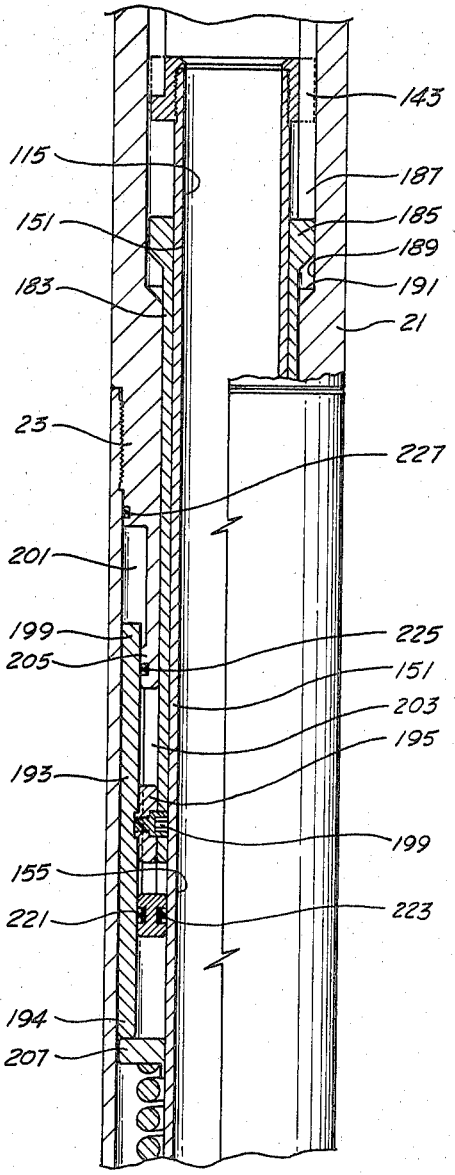
Figure 4:
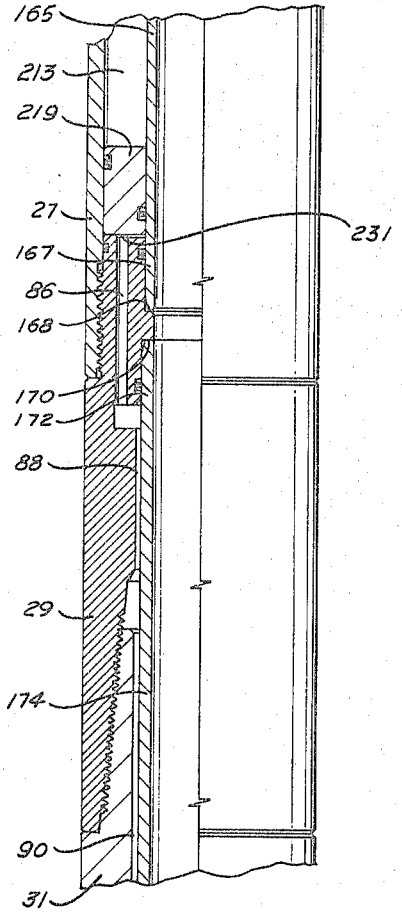

Top connection 13 is internally threaded on the upper end 15 for connection in the drill string and externally threaded on the lower end 17 for connection to the internally threaded upper portion 19 of a tubular housing 21. The lower portion 23 of tubular housing 21 (FIG. 2a) is threadedly connected to one end of an elongated, downwardly extending body section 25, the opposite end 27 (FIG. 4) of which is threadedly connected to an externally threaded connector sub 29. Sub 29 is threadedly connected to an externally threaded lower connector sub 31.

Sub 31 is threadedly connected to a weight operated sleeve 33 (FIG. 5a) having a splined lower end 35. Lower end 35 of weight operated sleeve 33 slidingly engages the splined surface 37 of an upper extent 39 of a bottom connection 46. Upper extent 39 of bottom connection 46 has an externally threaded surface 41 which engages a complimentary internally threaded surface of a guide sleeve 43.

Guide sleeve 43 has an inner circumferential rib 49 which engages a shoulder 51 of a lower spring-retaining ring 47, thereby securely positioning lower retaining ring 47 between the interior sidewalls 53 of guide sleeve 43, the exterior sidewalls 55 of weight operated sleeve 33 and the upper extent 39 of bottom connection 46. The bottom surface 57 of lower retaining ring 47 thus serves as an upper "stop" limiting the travel of splined lower end 35 of weight operated sleeve 33 along splined surface 37. A shoulder 59 in the interior of bottom connection 46 formed between splined surface 37 and bore 60 of bottom connection 46 serves as a lower "stop" for splined end 35.

The internal diameter of guide sleeve 43 is greater than the external diameter of weight operated sleeve 33, thereby defining an annular clearance 61 above lower retaining ring 47. A coil spring 63 is located in annular clearance 61 and has a lower extent 65 which contacts the upper surface 67 of retaining ring 47, and an upper extent 69. An upper spring retaining ring 71 is threadedly connected to the lower extent 73 of lower sub 31 between the exterior surface 75 of lower extent 73 and the interior sidewall 53 of guide sleeve 43. The bottom surface 81 of upper ring 71 contacts the upper extent 69 of coil spring 63. A pair of O-rings 77, 79 in upper retaining ring 71 sealingly engage sidewall 53 and surface 75 respectively to seal off that portion 83 of annular clearance 61 above ring 71 from inner bore 60.

A seal ring 89 is carried on exterior surface 75 of sub 31 between a stop ring 291 and a shoulder 85 formed in the exterior surface of sub 31 between exterior surface 75 and upper surface 87. Seal ring 89 is comprised of an upper ring 91, a lower ring 93, and a pair of circumferential elastomeric seals 95, 97 located between oppositely facing shoulders 98, 99 in rings 91, 93.

Figure 5A:
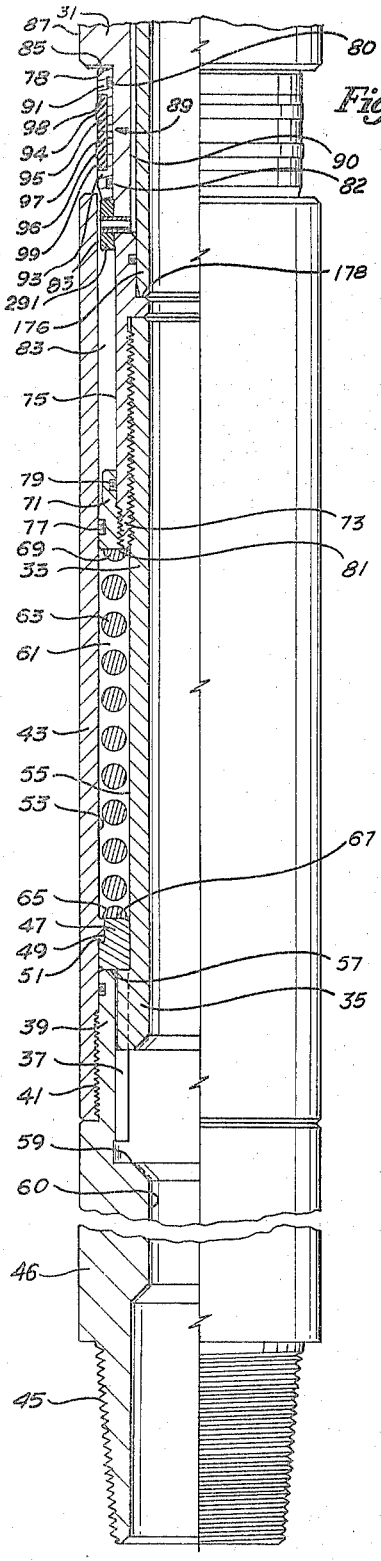
Figure 5B:
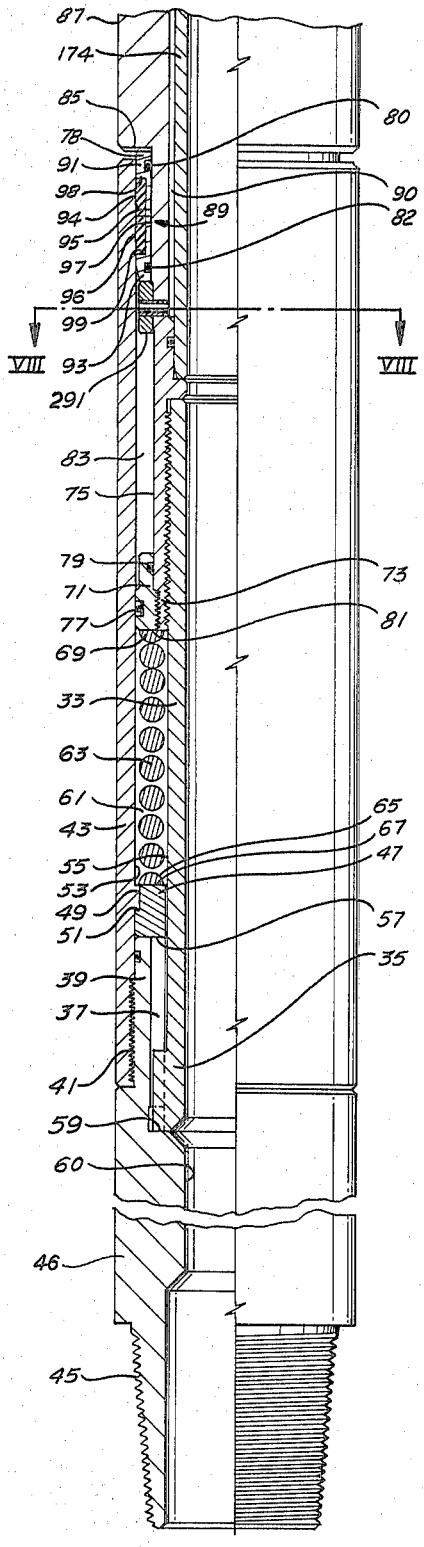

As shown in FIGS. 5a and 5b, the external diameter of seal ring 89 is slidingly received within the interior sidewall of guide sleeve 43 as lower end 35 of weight operated sleeve 33 moves toward shoulder 59. As seal ring 89 is received within guide sleeve 43, the upper surfaces 94, 96 of seals 95, 97 sealingly engages interior sidewall 53. O-rings 80, 82 are provided in the lower surfaces of rings 91, 93 respectively.

Figure 8:
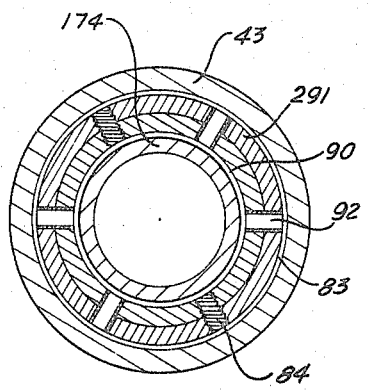
FIG. 8 is a cross-sectional view taken along lines VIII—VIII in FIG. 5*b*.

Stop ring 291, as shown in FIG. 8, has a series of ports 92 which communicate with a passageway 90 between the interior sidewall of sub 31 and an inner cylinder 174. Passageway 90 communicates with a similar passageway 88 (FIG. 4) between the interior sidewall of sub 29 and inner cylinder 174 which, in turn, communicates with a flow passage 86 (FIG. 4) in sub 29. Stop ring 291 is held in place about the exterior surface 75 of lower extent 73 by a series of shear screws 84 (FIG. 8).

Returning now to FIG. 1a, top connection 13 has an interior bore 103 to allow flow of fluids to the surface. The internal diameter of bore 103 increases toward the lower end 17, forming a shoulder 105 and seat bore 107. A ball seat 109 sealingly engages a ball 111 located within tubular housing 21. Ball 111 is generally spherical in shape with a passageway 113 extending through the ball and a small, generally circular opening 115 in one side.

Ball seat 109 is generally ring-shaped and has ears 117 which are received within the sidewalls of a depending member 119 where it is maintained in sealling engagement by "O" ring 121. The sidewalls 123 of depending member 119 are slidingly engaged by the interior surface of tubular housing 21. Depending member 119 has an external shoulder 125 and a longitudinal extent 127 which is slidingly received within the seat bore 107 of top connection 13. Resilient means, such as springs 129, are positioned between external shoulder 125 of depending member 119 and the lowermost extent 131 of top connection 13. Springs 129 thus serve to urge depending member 119 and ball seat 109 downwardly into engagement with ball 111, upward movement of longitudinal extent 127 within seat bore 107 serving to compress or load the springs 129. Movement of longitudinal extent 127 within bore 107 allows a proper seal to be maintained on ball 111 as the ball is shifted within tubular housing 21 and helps to compensate for dimensional variations in the parts of the device due to machining tolerances and the like.

Figure 9:
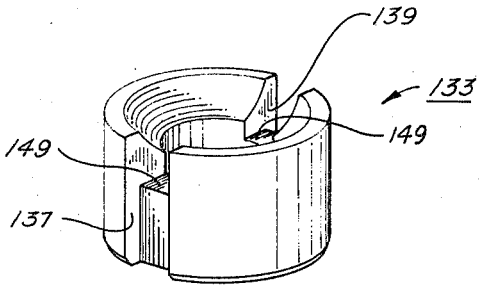
FIG. 9 is an isolated view of the ball support ring of the valve.

As shown in FIG. 1a, ball 111 rests on a support ring 133 which in turn rests on a ledge 135 within tubular housing 21. Support ring 133 as shown in FIG. 9, has oppositely positioned slots 137, 139 in which first and second shifting linkages 141, 143 respectively are free to slide. Outwardly extending flanges 145, 147 (FIG. 1a) of linkages 141, 143 are received by a shoulder 149 within the interior of support ring 133, thus limiting downward travel of the linkages 141, 143. Upward travel of linkages 141, 143 is limited by engagement with the lower surface of ball seat 109, and the lower end of depending member 119.

Figure 1B:
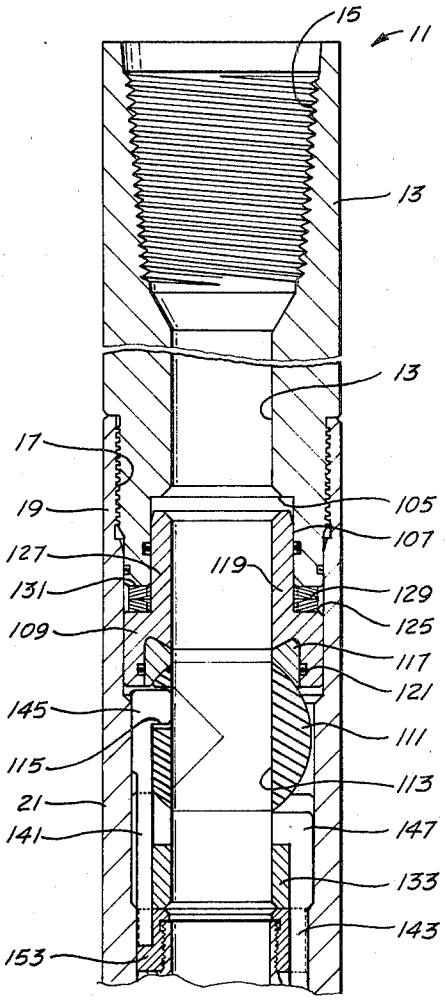
Figure 6:
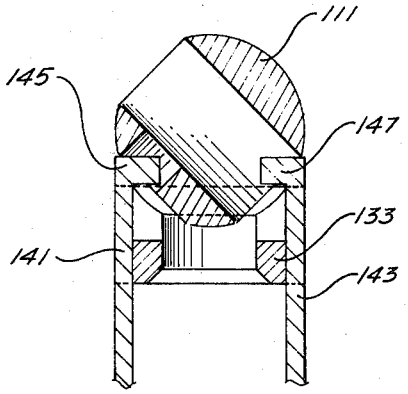
FIG. 6 is a simplified view of the operation of the ball of the valve showing the movement of the ball from the closed to the open position.
Figure 7:
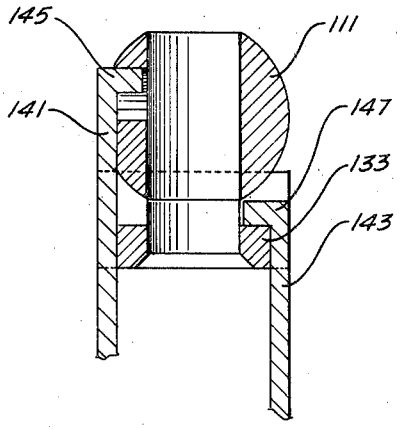
FIG. 7 is similar to FIG. 6 but shows the ball in the fully open position.

As shown in FIGS. 6 and 7, upward movement of first shifting linkage 141 accompanied by opposite relative movement of second shifting linkage 143 causes ball 111 to shift from the closed position shown in FIG. 1a to the open position shown in FIGS. 1b and 7.

Figure 3A:
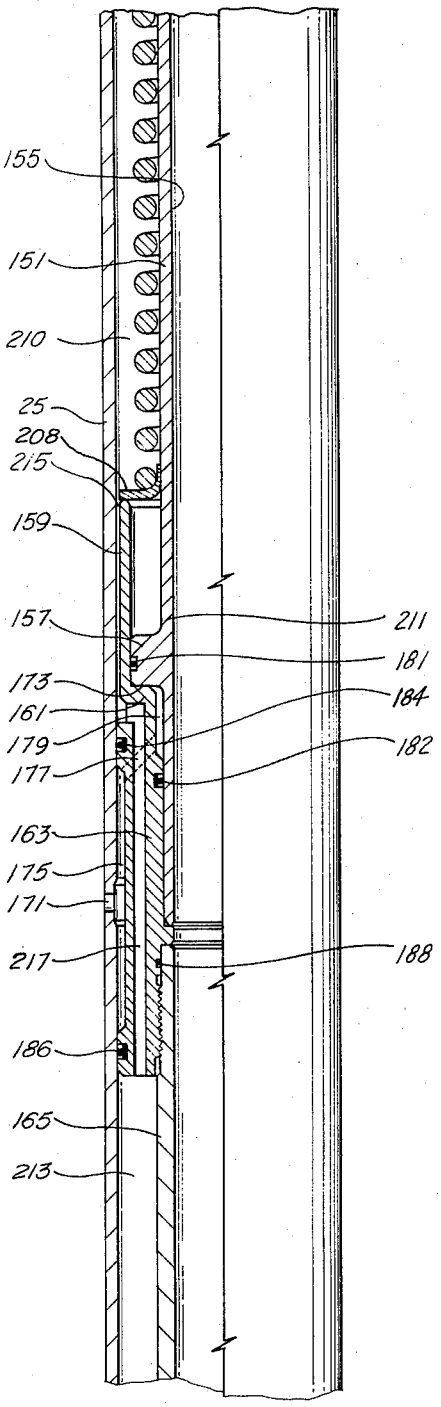
Figure 3B:
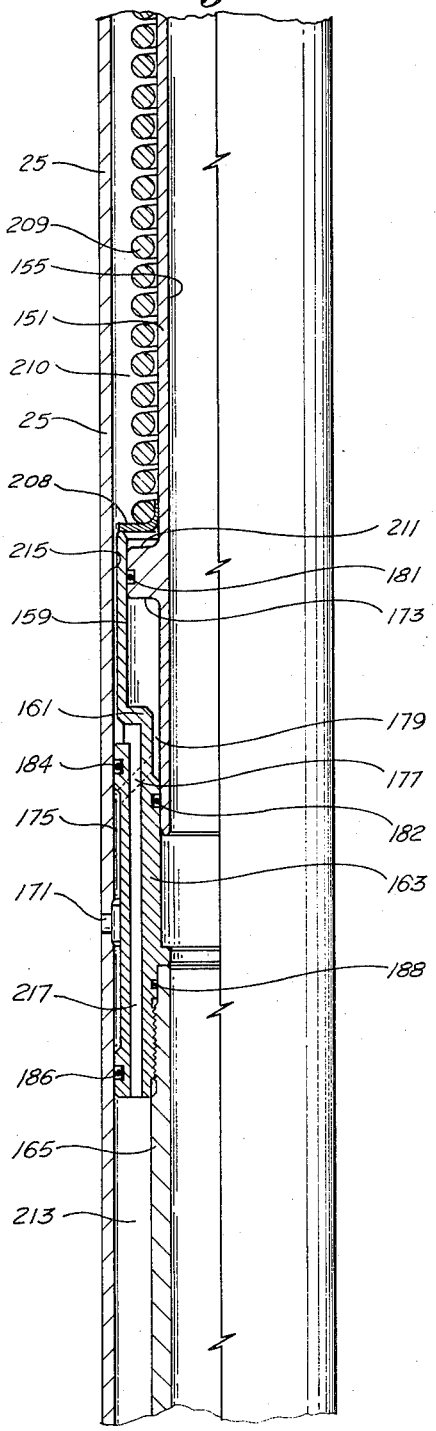

The end of shifting linkage 141 opposite flange 145 is connected to a pressure operated mandrel 151 (FIG. 1a) by means of a coupling 153. Pressure mandrel 151 has an interior bore 155 which communicates with the surface and has an enlarged circumferential protrusion or piston ring 157 (FIG. 3a) which slidingly engages the internal diameter of a collar 159. Collar 159 has a shoulder 161 which limits the downward travel of ring 157 and a cylindrical lower portion 163 which threadedly engages a cylindrical member 165. Cylindrical member 165 has a lower end 167 (FIG. 4) which is supported on an interior ledge 168 in connector sub 29. An oppositely facing ledge 170 in tool connector sub 29 contacts the upper end 172 of inner cylinder 174. The opposite end 176 rests on a shoulder 178 in sub 31.

A port 171 in body section 25 (FIG. 3a) allows fluid communication between the well annulus and the bottom wall 173 of piston ring 157 by means of fluid passages 175, 177, and 179. An "O" ring 181 assures a tight seal between ring 157 and collar 159. Pressure operated mandrel 151 is thus operable between a retracted position as shown in FIGS. 1*a*, 2*a*, 3*a*, 4, and 5*a* and an extended position as shown in FIGS. 1*b*, 2*b*, 3*b*, 4, and 5*b* responsive to pressure in the well annulus acting through port 171 and passages 175, 177, and 179 on the bottom wall 173 of piston ring 157. As shown in FIGS. 1*a* and 1*b*, movement of mandrel 151 from the retracted position to the extended position causes upward movement of the first shifting linkage 141 to move the ball 111 from the closed position to the open position.

An outer sleeve 183 (FIG. 1*a*) surrounds the upper extent of pressure operated inner mandrel 151 and has an upper lip 185 adapted to slidingly engage the interior sidewalls 189 of tubular housing 21. Coupling 153 limits the upward travel of outer sleeve 183 but allows the lower end 187 of second shifting linkage 143 to contact upper lip 185. Downward movement of linkage 143 thus causes corresponding downward movement of outer sleeve 183 until lip 185 contacts a shoulder 191 (FIG. 2*a*) in tubular housing 21.

The end of outer sleeve 183 opposite lip 185 is attached to a spring sleeve 193 by means of a sliding block 195 and screw 197. The upper end 199 of spring sleeve 193 is slidably received within a recess 201 between the lower portion of tubular housing 21 and the interior sidewalls of body section 25. Sliding block 195 is contained within a window 203 in the lowermost extent 205 of tubular housing 21.

The bottom end 194 of spring sleeve 193 rests on a spring retainer ring 207. A coil spring 209 is positioned about the lower extent of pressure mandrel 151 in the space 210 between mandrel 151 and the interior sidewalls of body section 25. Spring 209 is maintained in compression by retainer ring 207 and a lower retaining ring 208 carried on the upper extent of collar 159.

Space 210 between body section 25 (FIG. 3*a*) and pressure mandrel 151 communicates with a similar space 213 between cylindrical member 165 and body section 25 by means of an opening 215 between collar 159 and body section 25 and by means of conduit 217 through cylindrical lower portion 163 of collar 159. Spaces 210 and 213 together comprise a pressure chamber containing a pressurized fluid, preferably nitrogen gas. A balancing piston 219 (FIG. 4) located in space 213 seals the lower end of the chamber and "T-seals" 221, 223, 225 (FIG. 2*a*) and "O"-ring 227 in tubular housing 21 seal the upper end of the chamber. "T-seals" 182, 184, 186 (FIG. 3*a*), and "O"-ring 188 in lower portion 163 of collar 159 seal off the chamber from port 171 and passageways 175, 177 and 179.

As shown in FIG. 5*a*, when weight operated sleeve 33 is in the position shown, pressure in the well annulus communicates with the lower wall 231 (FIG. 4) of balancing piston 219 by means of flow passage 86, passageways 88 and 90, ports 92 in stop ring 291 and the annular clearance 83 (FIG. 8) between stop ring 291 and guide sleeve 43.

The operation of the annulus operated test valve will now be described in greater detail.

PLACEMENT

FIGS. 1*a*, 2*a*, 3*a*, 4, and 5*a* show the test valve arranged for "running in" and placement in the well bore. Ball 111 is in the closed position shutting off flow through interior bore 103. The pressure chamber, comprising spaces 210, 213, and connecting conduit 217, is filled with nitrogen gas at, for example, 3000 psi by means of an inlet valve (not shown). Weight operated sleeve 33 (FIG. 5*a*) is in the "up" position allowing fluid communication between the well annulus and the lower wall 231 of balancing piston 219 by means of ports 92 passageways 88 and 90, and flow passages 83 and 86.

Pressure in the well annulus also acts on the bottom wall 173 of piston ring 157 by means of port 171 and passageways 175, 177 and 179 tending to force piston ring 157 and pressure operated mandrel 151 upward from the retracted to the extended position shown in FIGS. 1*b*, 2*b*, 3*b*, 4 and 5*b*. Were it not for the pressure balancing feature of the invention, upward movement of mandrel 151 would engage first shifting linkage 141 by means of coupling 153. Upward movement of first shifting linkage 141 would then cause the ball 111 to rotate to the open position as shown in FIGS. 6 and 7 and be accompanied by downward movement of second shifting linkage 143.

Lower end 187 of second shifting linkage 143 would then contact upper lip 185 of outer sleeve 183 which is connected to spring sleeve 193 through sliding block 195. Downward movement of spring sleeve 193 would compress coil spring 209 and, along with the upward movement of mandrel 151 and piston ring 157, reduce the available volume of the pressure chamber thereby exerting a downward force on balancing piston 219.

Mandrel 151, shifting linkages 141, 143, outer sleeve 183, spring sleeve 193, and spring 209, thus comprise operating means for moving the ball 111 between the open and closed positions responsive to pressure in the annulus.

Now, assume that while running into the well bore the pressure in the surrounding annulus is 2000 psi. There is thus a 2000 psi force acting toward on the bottom wall 173 of piston ring 157 tending to move mandrel 151 upward to open the ball 111. However, there is also a 3000 psi force exerted by the nitrogen gas in the pressure chamber acting on the top wall 211 of piston ring 157 which acts to hold the mandrel 151 in place and hold the ball 111 closed.

Assume now that a greater depth is reached and annulus pressure increases to 4000 psi. The 4000 psi pressure differential which acts on piston ring 157 would now act to cause upward movement of the mandrel 151 and rotate the ball 111 as has been described were it not for the annulus pressure which acts on balancing piston 219 through ports 92, passageways 83, 88 and 90, and flow passage 83. This pressure causes balancing piston 219 to move up in space 213 until pressure above and below piston 219 is equalized. Because the pressure acting on the bottom wall 173 of piston ring 157 is then equal to the pressure acting on the top wall 211 of piston ring 157, the pressure differential is eliminated thereby preventing movement of the mandrel 151.

Thus, as long as weight operated sleeve 33 is in the position shown in FIG. 5*a*, balancing piston 219 moves up and down in space 213 to compensate for fluctuations in annular pressure and prevent premature opening of ball 111.

TESTING

Assume now that the test tool has been placed in the well bore at the desired depth and that the oil producing formation has been sealed off by a packer located in the drill stem below the test tool. It is *now* desirable to shift the ball 111 to the open position to allow flow up the main tubular bore 103.

Weight is first applied to the drill stem causing weight operated sleeve 33 (FIG. 5*b*) to move downward with stop ring 291 being slidingly received within guide sleeve 43 and seals 95, 97 of seal ring 89 sealingly engaging the interior sidewall 53 of guide sleeve 43, thereby sealing off annular space 83 and ports 92 in stop ring 91 from communication with the well annulus. Weight operated sleeve 33 continues to move downwardly until splined lower extent 35 contacts shoulder 59 in bottom connection 46.

Now assume the annulus is enclosed at the surface and pressured up to 6000 psi. The 6000 psi force acts through port 171 and passageways 175, 177, and 179 on the bottom wall 173 of piston ring 157 forcing mandrel 151 upward. This 6000 psi upward force overcomes the lesser "locked in" pressure in the nitrogen chamber and causes the ball to shift to the open position as previously described.

When testing is completed, the annulus pressure is relieved and spring 209 acts through retainer ring 207, spring sleeve 193, outer sleeve 183 and second shifting linkage 143 to rotate the ball to the closed position.

As a safety measure, the ball can also be rotated to the closed position by an increase in annulus pressure acting on the upper end 78 (FIG. 5*b*) of seal ring 89 thereby overcoming the pressure in clearance 83 and passageway 90 causing shear screws 84 in stop ring 291 to shear. Once shear screws 84 are severed, seal ring 89 and stop ring 291 slide down annular clearance 83 thereby opening passageway 90 and ports 92 to the well annulus.

Balancing piston 219, spaces 210, 213, passageways 83, 88, 90 and flow passage 86, thus comprise a pressure balancing means which is movable between an active position responsive to pressures in the well annulus to prevent movement of the operating means and a static position to allow movement in the operating means. Weight operated sleeve 33, guide sleeve 43, stop ring 291, and seal ring 89 comprise an actuating means for moving the pressure balancing means between the active and static positions.

An invention has been provided with significant advantages. The present annulus operated test valve is pressure operated from the surface without rotating the drill string, making it especially suited for use in deviated well bores. A pressure balancing means compensates for fluctuations in annular pressure as the tool is being placed or retrieved from the well bore and prevents premature opening of the ball. The balancing means can be tailored to the particular well conditions by the choice of pressure in the nitrogen chamber, i.e., the nitrogen chamber can be charged to a greater initial pressure where testing will be carried out at greater depths. The spring which assists in closing the ball is located in the nitrogen chamber and is isolated from well bore fluids. By running the tool into the well bore with the ball closed, the tubing string is kept "dry." The ball rotation mechanism is simple in design and dependable in operation.

While the invention has been shown in only one of its forms, it should be apparent to those skilled in the art that it is not thus limited but is susceptible to various changes and modifications without departing from the spirit thereof.

We claim:

1. In a well annulus operated valve for drill string test tools having a ball rotatable between an open position to allow flow through the drill string for testing and a closed position to block flow through the drill string during placement and retrieval operations, wherein the improvement comprises:

a pair of shifting linkages extending from opposite sides of said ball, said linkages being adapted to shift in opposite relative directions to open and close said ball;

a pressure operated inner mandrel slidably engaging the first of said shifting linkages, said mandrel being movable between extended and retracted positions responsive to pressures in the well annulus, thereby shifting said first linkage to rotate said ball;

pressure balancing means movable between an active position responsive to pressure in the well annulus to prevent movement of said inner mandrel and a static position to allow movement of said inner mandrel; and actuating means for moving said pressure balancing means between said active and static position.

2. In a well annulus operated valve for drill string test tools having a ball rotatable between an open position to allow flow through the drill string for testing and a closed position to block flow through the drill string during placement and retrieval operations, wherein the improvement comprises:

a pair of shifting linkages extending from opposite sides of said ball, said linkages being adapted to shift in opposite relative directions to open and close said ball;

a pressure operated inner mandrel slidably engaging the first of said shifting linkages, said mandrel being movable between extended and retracted positions responsive to pressures in the well annulus, thereby shifting said first linkage to rotate said ball;

a spring sleeve surrounding said inner mandrel and slidably engaging said second shifting linkage so that movement of said inner mandrel and first shifting linkage causes opposite relative movement of said spring sleeve and second shifting linkage;

pressure balancing means movable between an active position responsive to pressures in the well annulus to prevent movement of said inner mandrel and a static position to allow movement of said inner mandrel; and actuating means for moving said pressure balancing means between said active and static positions.

3. In a well annulus operated valve for drill string test tools having a ball rotatable between an open position to allow flow through the drill string for testing and a closed position to block flow through the drill string during placement and retrieval operations, wherein the improvement comprises:

a pair of shifting linkages extending from opposite sides of said ball, said linkages being adapted to shift in opposite relative directions to open and close said ball;

a pressure operated inner mandrel slidably engaging the first of said shifting linkages, said mandrel being movable between extended and retracted positions responsive to pressures in the well annulus, thereby shifting said first linkage to rotate said ball;

a spring sleeve surrounding the upper extent of said inner mandrel and slidably engaging said second shifting linkage so that movement of said inner mandrel and first shifting linkage causes opposite relative movement of said spring sleeve and second shifting linkage;

a spring positioned about the lower extent of said inner mandrel below said spring sleeve, said spring being compressed when said inner mandrel is extended;

pressure balancing means movable between an active position responsive to pressures in the well annulus to prevent movement of said inner mandrel and a static position to allow movement of said inner mandrel; and actuating means for moving said pressure balancing means between said active and static positions.

4. The well annulus operated valve of claim 3, wherein said pressure operated inner mandrel has a piston ring formed about the lower extent thereof, said piston ring having a bottom wall in communication with the well annulus and wherein movement of said mandrel between said retracted and extended positions causes said piston ring to compress the fluid in said pressure chamber.

5. The well annulus operated valve of claim 4, wherein said pressure balancing means comprises a fluid containing pressure chamber having a balancing piston at one end thereof, said balancing piston having a lower wall in communication with the well annulus when said pressure balancing means is in said active position and wherein said lower wall is isolated from said well annulus when said pressure balancing means is in said static position.

6. The well annulus operated valve of claim 5, wherein said lower wall of said balancing piston in said fluid containing pressure chamber communicates with the well annulus by means of a passageway and wherein said actuating means comprises a weight operated sleeve selectively operable to open and close said passageway.

7. The well annulus operated valve of claim 6, further comprising:

a cylindrical guide sleeve having interior sidewalls adapted to slidingly receive said weight operated sleeve;

a seal ring carried on said weight operated sleeve, said seal ring having an elastomeric seal for sealingly engaging said guide sleeve interior sidewalls and thereby close said passageway connecting said lower wall of said balancing piston with said well annulus.

8. The well annulus operated valve of claim 7, further comprising:

a pressure severable stop ring carried on said weight operated sleeve below said seal ring, whereby severing said stop ring communicates the well annulus with said passageway leading to said lower wall of said balancing piston.

9. The well annulus operated valve of claim 8, wherein said weight operated sleeve is spring biased toward said active position.

10. The well annulus operated valve of claim 9, wherein said weight operated sleeve is operated to move said pressure balancing means to said static position by setting weight down on said drill string.

* * * * *